US011369823B2

(12) United States Patent
Dominique

(10) Patent No.: US 11,369,823 B2
(45) Date of Patent: Jun. 28, 2022

(54) EXERCISE APPARATUS

(71) Applicant: Gerald Dominique, Montreal-Nord (CA)

(72) Inventor: Gerald Dominique, Montreal-Nord (CA)

(73) Assignee: Gerald Dominique, Montreal-Nord (CA)

( * ) Notice: Subject to any disclaimer, the term of this patent is extended or adjusted under 35 U.S.C. 154(b) by 0 days.

(21) Appl. No.: 16/911,860

(22) Filed: Jun. 25, 2020

(65) Prior Publication Data

US 2020/0406084 A1 Dec. 31, 2020

Related U.S. Application Data

(60) Provisional application No. 62/921,569, filed on Jun. 25, 2019.

(51) Int. Cl.

| | |
|---|---|
| ***A63B 21/04*** | (2006.01) |
| ***A63B 21/02*** | (2006.01) |
| ***A63B 21/00*** | (2006.01) |
| ***A63B 21/002*** | (2006.01) |
| ***A63B 71/00*** | (2006.01) |
| ***A63B 21/055*** | (2006.01) |

(52) U.S. Cl.

CPC ..... *A63B 21/0407* (2013.01); *A63B 21/0023* (2013.01); *A63B 21/00043* (2013.01); *A63B 21/023* (2013.01); *A63B 21/4023* (2015.10); *A63B 21/4043* (2015.10); *A63B 21/0552* (2013.01); *A63B 2071/009* (2013.01)

(58) Field of Classification Search

CPC ..... A63B 21/00043; A63B 21/0023; A63B 21/023; A63B 21/0407; A63B 21/0603; A63B 21/0604; A63B 21/065; A63B 21/15; A63B 21/285; A63B 21/4023; A63B 21/4043; A63B 21/0004; A63B 2071/009; A63B 21/025; A63B 21/04; A63B 21/055; A63B 21/0552; A63B 21/0555; A63B 21/0557; A63B 21/06; A63B 21/0608

See application file for complete search history.

(56) References Cited

U.S. PATENT DOCUMENTS 4,489,937 A * 12/1984 Kong ..... A63B 21/00043 482/126
4,651,985 A * 3/1987 Salisbury ..... A63B 21/00043 482/122

(Continued)

*Primary Examiner* — Megan Anderson
(74) *Attorney, Agent, or Firm* — BCF LLP

(57) ABSTRACT

An exercise apparatus includes at least one resilient member; a first weight connected to a first end portion of the at least one resilient member; a second weight connected to a second end portion of the at least one resilient member, and a holding member connected to a center portion of the at least one resilient member, the center portion being between the first and second end portions. Another exercise apparatus includes a holding member; a first resilient member having first and second end portions, the first end portion being connected to the holding member; a first weight connected to the first resilient member; a second resilient member having first and second end portions, the first end portion being connected to the holding member opposite the first end portion of the first resilient member; a second weight connected to the second resilient member.

12 Claims, 5 Drawing Sheets

(56) References Cited

U.S. PATENT DOCUMENTS

| | | | | |
|---|---|---|---|---|
| 6,872,174 | B2 * | 3/2005 | Benach | A63B 21/00043 482/121 |
| 7,722,510 | B2 * | 5/2010 | Jhu | A63B 21/027 482/106 |
| 2012/0077648 | A1 * | 3/2012 | Farrow | A63B 21/055 482/110 |
| 2012/0289382 | A1 * | 11/2012 | Haddad | A63B 21/0603 482/93 |
| 2016/0038793 | A1 * | 2/2016 | Kikel | A01B 45/02 310/38 |

* cited by examiner

EXERCISE APPARATUS

CROSS-REFERENCE

The present application claims priority to U.S. Provisional Application No. 62/921,569, entitled "Portable Exercise Apparatus and Method of Using the Same," filed Jun. 25, 2019, the entirety of which is incorporated herein by reference.

TECHNICAL FIELD

The present description relates to the field of exercise apparatus.

BACKGROUND

In order to keep healthy muscles, joints, etc., some people choose to workout or practice sports, sometimes at a high level of endurance and/or strength. This can sometimes result in damage to skeletal muscles, critical joints and/or tendons. Some people may also not be able to practice sports or strenuous exercise, such as the elderly.

Various portable exercise apparatuses exist on the market to improve muscle strength, endurance, or both, while being less strenuous. These devices do not always focus on rehabilitating specific skeletal muscles, joints and/or tendons. A few devices may only combine isometric contraction, for example.

There is therefore a desire for an exercise apparatus for exercising skeletal muscles, joints and/or tendons while aiding in avoiding negative outcomes sometimes associated with strenuous exercise.

SUMMARY

It is an object of the present technology to ameliorate at least some of the inconveniences present in the prior art.

According to a first embodiment of the present technology, there is provided an exercise apparatus including at least one resilient member; a first weight connected to a first end portion of the at least one resilient member; a second weight connected to a second end portion of the at least one resilient member, and a holding member connected to a center portion of the at least one resilient member, the center portion being disposed between the first end portion and the second end portion.

In some embodiments, the apparatus further includes a handle portion connected to the holding member.

In some embodiments, the apparatus further includes a spring connected between the handle portion and the holding member.

In some embodiments, the holding member is ergonomically shaped to be held in a hand of a user.

In some embodiments, the apparatus further includes at least one receiving member connected to the holding member, the at least one receiving member being configured for removably connecting at least one additional element thereto.

In some embodiments, the at least one receiving member is at least one bracket.

In some embodiments, the at least one additional element includes at least one of a weight and a spring.

In some embodiments, the apparatus further includes at least one handling member extending from the holding member.

In some embodiments, the apparatus further includes at least one protective casing disposed around the at least one resilient member.

In some embodiments, the apparatus further includes when the apparatus is held aloft by the holding member: the first weight weighs enough the flex the first end portion downward with respect to the center portion; and the second weight weighs enough the flex the second end portion downward with respect to the center portion.

In some embodiments, the apparatus further includes the at least one resilient member is a coil spring.

According to another embodiment of the current technology, there is provided an exercise apparatus including a holding member; a first resilient member having first and second end portions, the first end portion being connected to the holding member; a first weight connected to the second end portion of the first resilient member; a second resilient member having first and second end portions, the first end portion being connected to the holding member opposite the first end portion of the first resilient member; a second weight connected to the second end portion of the second resilient member.

In some embodiments, the apparatus further includes a handle portion connected to the holding member.

In some embodiments, the apparatus further includes a spring connected between the handle portion and the holding member.

In some embodiments, the holding member is ergonomically shaped to be held in a hand of a user.

In some embodiments, the apparatus further includes at least one receiving member connected to the holding member, the at least one receiving member being configured for removably connecting at least one of a weight and a spring.

In some embodiments, the apparatus further includes at least one handling member extending from the holding member.

In some embodiments, the apparatus further includes first and second protective casings disposed around the first and second resilient members respectively.

In some embodiments, when the apparatus is held aloft by the holding member: the first weight weighs enough the flex the distal end portion of the first resilient member downward with respect to the holding member; and the second weight weighs enough the flex the distal end portion of the resilient member downward with respect to the holding member.

In some embodiments, the first and second resilient members are coil springs.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein. The explanations provided above regarding the above terms take precedence over explanations of these terms that may be found in any one of the documents incorporated herein by reference.

Additional and/or alternative features, aspects and advantages of embodiments of the present technology will become apparent from the following description, the accompanying drawings and the appended claims.

BRIEF DESCRIPTION OF THE DRAWINGS

Further features and advantages of the present disclosure will become apparent from the following detailed description, taken in combination with the appended drawings, in which.

Figure 1A:
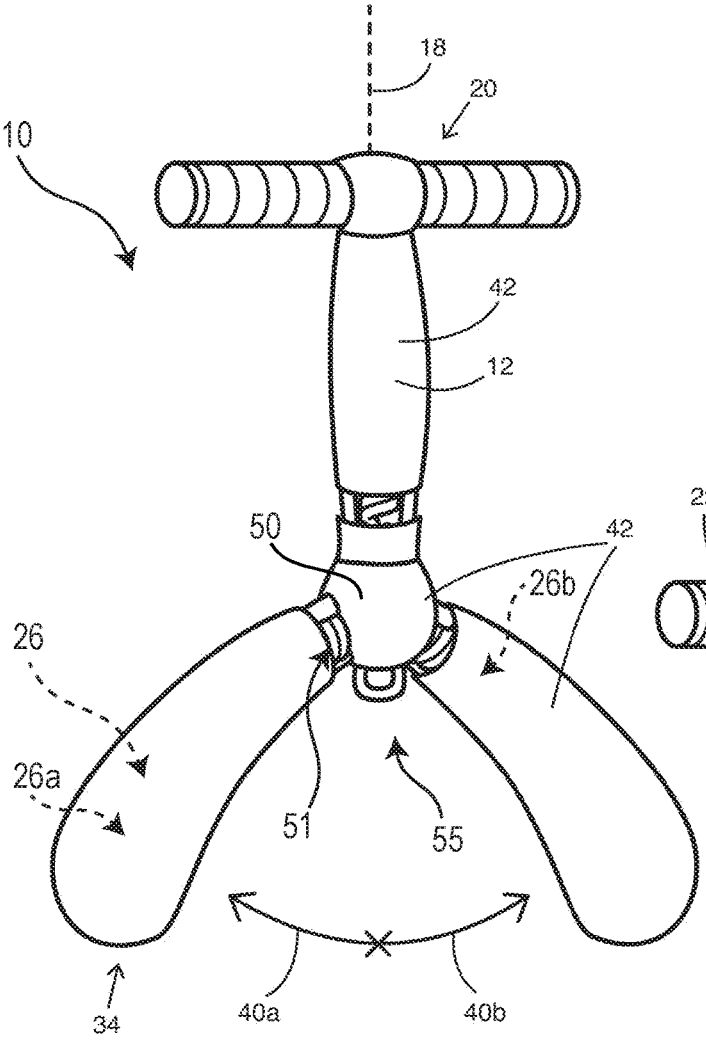
FIG. 1A is a front, right side perspective view of an exercise apparatus, shown in a first position.

It should be noted that the Figures may not be drawn to scale.

DETAILED DESCRIPTION

Referring now to the drawings and more particularly to FIGS. 1A, 1B, 2A and 2B, there is shown an exercise apparatus 10. The exercise apparatus is also referred to as a portable exercise apparatus 10 or an apparatus 10. The apparatus 10 includes a resilient member 26 (best seen in FIGS. 2A and 2B). The resilient member 26 defines a first end portion 28 and a second end portion 32. The resilient member 26 further defines a center portion 30, disposed between and approximately equidistant from the ends 28, 32.

The resilient member 26 is a coil spring 26 in the illustrated embodiment. Depending on the embodiment, the spring 26 may take the form of a spring of any suitable strength level, shape, size and/or configuration, depending on the desired response (described further below). In some embodiments, it is contemplated that the resilient member 26 could be formed from different materials and in different configurations, including but not limited to: an elastic material such as rubber, plastic, carbon fiber, silicone, latex, polyurethane, thermoplastic elastomers (TPE, TPR), and/or in the configuration of a resilient rod or blade.

In some embodiments, the resilient member 26 can be formed from two or more resilient members. One such embodiment will be described in greater detail below.

As can be seen from the Figures, the spring 26 is sufficiently flexible to allow bending of the resilient member 26 such that the end portions 28, 32 are disposed below the center portion 30 when the apparatus 10 is held aloft, upright, and still. Movement of the end portions 28, 32 will be discussed in more detail below.

The apparatus 10 also includes a holding member 50 connected to the resilient member 26. The resilient member 26 extends through an aperture 51 in the holding member 50, such that the holding member 50 is disposed around the center portion 30 of the resilient member 26. The holding member 50 and the resilient member 26 are connected together by glue, but other methods of maintaining their relative positioning are contemplated. These methods could include tape, metal armature, and the member 50 being thermoformed around the resilient member 26. The holding member 50 is formed from rigid plastic. It is contemplated that the member 50 could be formed from various materials, including but not limited to: rubber, wood, rigid plastic, carbon fiber, PVC, thermoplastic, latex, silicone, natural gum, and metal. In embodiments where the resilient member 26 is formed from multiple resilient members, each resilient member could be connected to the holding member 50.

The apparatus 10 further includes two weights 34 and 36. The first weight 34 is connected to the first end portion 28 of the resilient member 26 and the second weight 36 is connected to the second end portion 32 of the resilient member 26. Each one of the first and second weights 34, 36 are formed by an external envelope 48*a*, 48*b* respectively, which receives therein sand to provide mass to the weights 34, 36. It is contemplated that the weights 34, 36 could include a variety of solid or semi-solid materials with their external envelopes 48*a*, 48*b*, including but not limited to: metal beads, particles made of polymeric material, sand, and various mixtures thereof. In some embodiments, the weights 34, 36 could be selectively removable and replaceable in order to change the overall mass of the apparatus 10 if desired.

In the present embodiment, the apparatus 10 further includes a resilient elongated body 12 connected to the holding member 50, specifically a coil spring 12. It is contemplated that the body 12 could be formed from different substantially elastic or flexible materials or non-resilient materials, depending on the embodiment. It is also contemplated that the apparatus 10 could omit the body 12 in some embodiments. The body 12 defines a first end 14 and a second end 16, the second end 16 being capable of displacement along a longitudinal axis 18 relative to the first end 14 due to the elastic nature of the body 12, as will be described in more detail below.

The apparatus 10 further includes a handle portion 20 connected to the first end 14 of the body 12. The handle portion 20 includes a first handle element 22 and a second handle element 24, both the first and second handle elements 22, 24 extending perpendicularly from the first end 14 of the body 12. The handle portion 20 could have a different shapes and/or configurations to allow a user to grip the apparatus 10.

Figure 3:
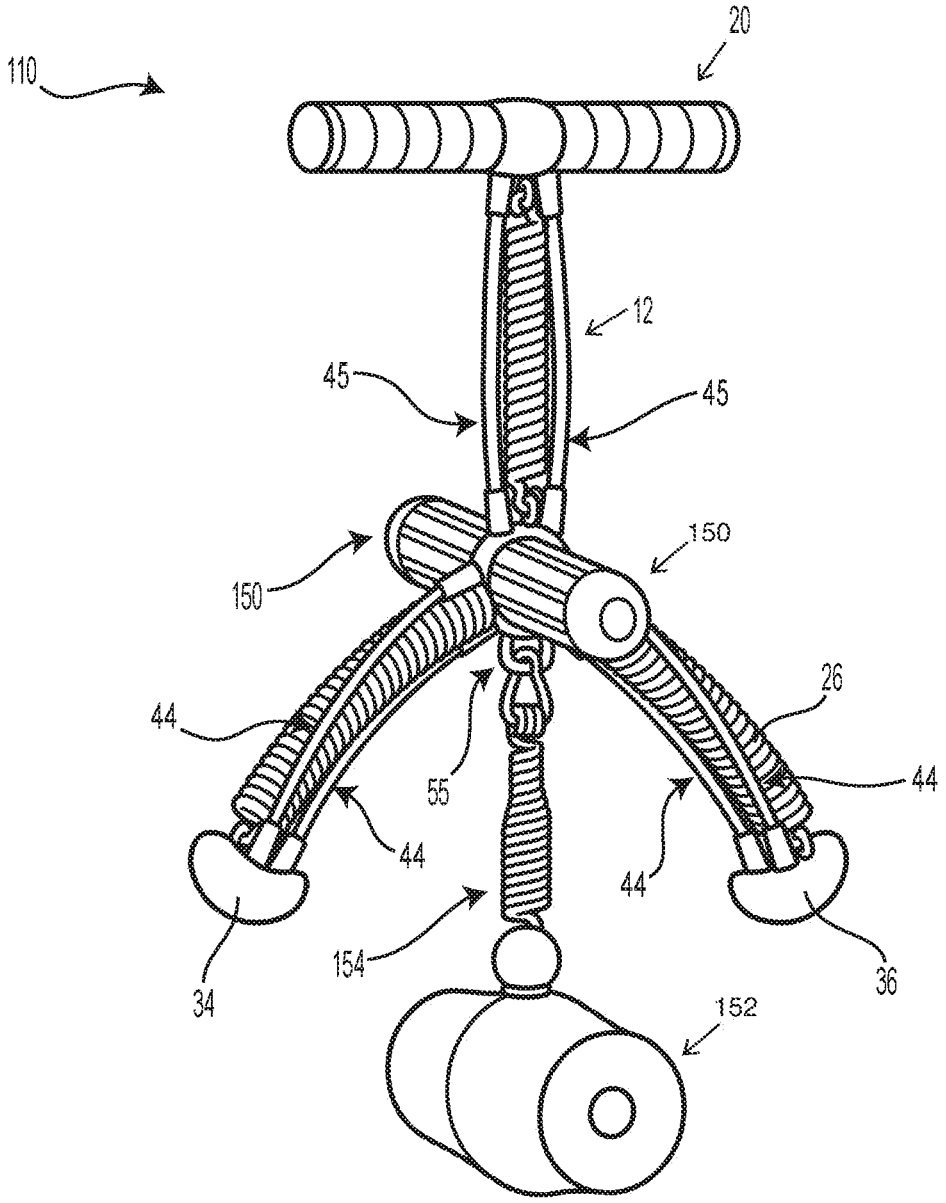
FIG. 3 is a front, right side perspective view of another embodiment of an exercise apparatus according to the present technology.

The apparatus 10 further includes a receiving member 55 connected to the holding member 50 for removably connecting different accessories to the apparatus 10, specifically a bracket 55 in the present embodiment. In FIG. 3, another embodiment of an apparatus 110 is illustrated with a weight 152 connected to the bracket 55 by an additional spring 154, as will be described further below. In different embodiments, the holding member 50 could include different mechanisms for attaching additional accessories thereto, including but not limited to: one or more loops, eye bolts, hooks, a solid structure, and metal wire armature. It is also contemplated that the holding member 50 could define an aperture therein for connecting accessories to the apparatus 10.

Figure 1B:
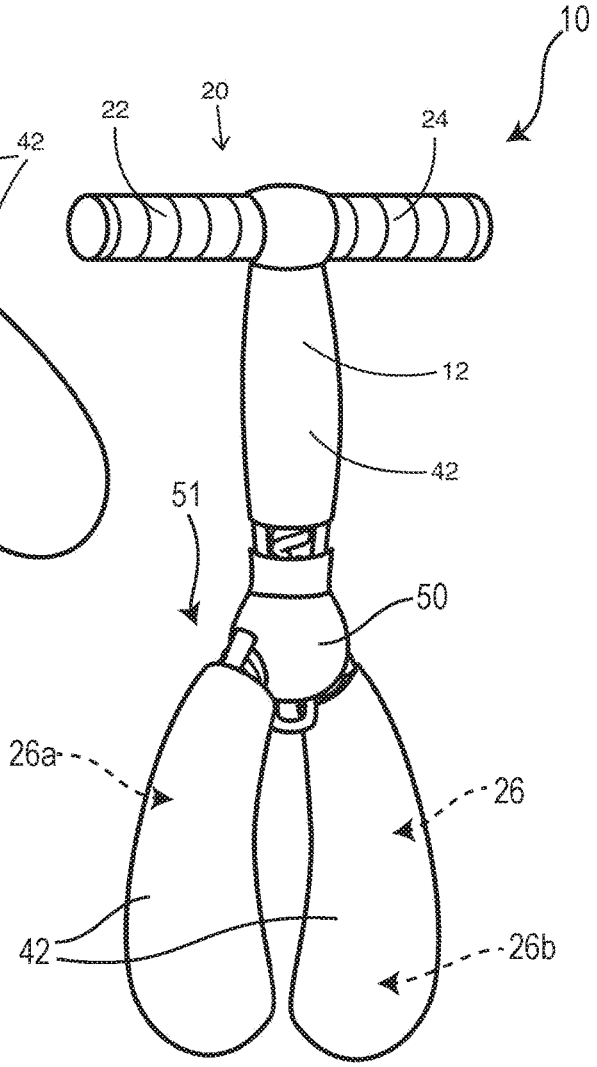
FIG. 1B is the front, right side perspective view of the exercise apparatus of FIG. 1A, shown in a second position.

As is shown in FIGS. 1A and 1B, the apparatus 10 further includes several flexible protective casings 42. In the present embodiment, the casings 42 are formed from a thin rubber sheet, but various flexible or resilient materials could be used. The casings 42 could also be formed from PVC, latex silicone, vinyl, thermoplastic, neoprene, carbon fiber, polyurethane, textile, although this list is not meant to be limiting. The casings 42 aid in protecting portions of the apparatus 10, such as the springs 12, 26 of the illustrated embodiment. It is contemplated that the casings 42 may be omitted in some embodiments. For example, where the resilient member 26 is implemented as a rubber cylinder casings may not be necessary or useful.

Figure 2A:
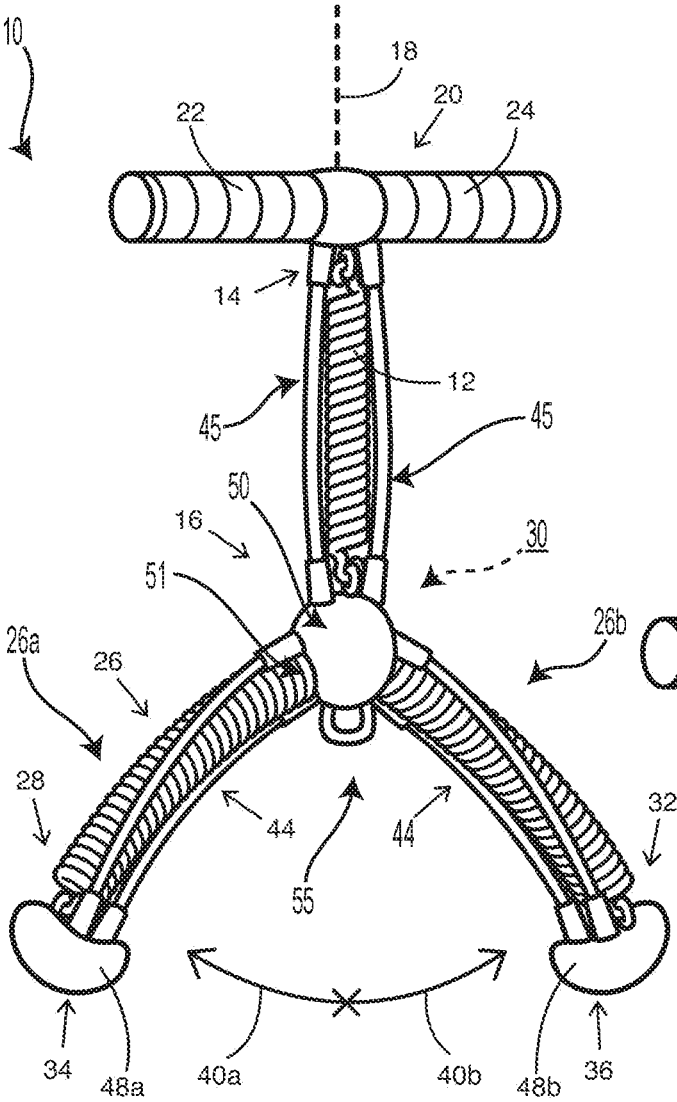
FIG. 2A is the front, right side perspective view of the exercise apparatus of FIG. 1A, shown without its external protective casing.
Figure 2B:
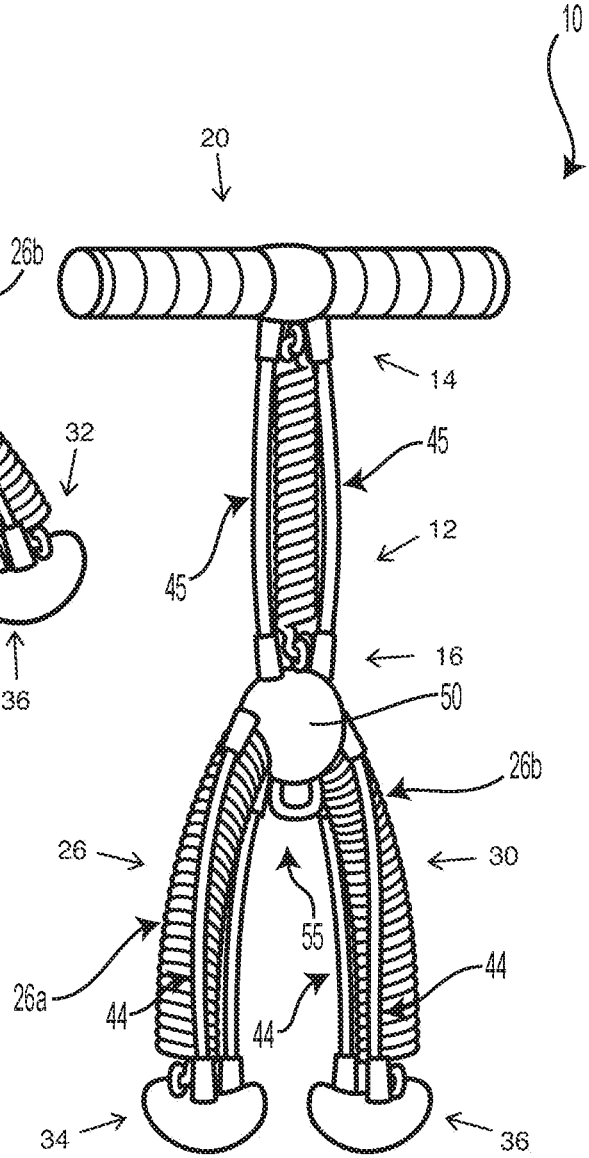
FIG. 2B is a front, right side perspective view of the exercise apparatus of FIG. 1B, shown without its external protective casing.

As is illustrated in FIGS. 2A and 2B, the apparatus 10 further includes a plurality of elastic straps 44. The elastic straps 44 extend between the holding member 50 and the weights 34 and 36. The elastic straps 44 aid in restricting displacement of the first and second weights 34, 36, to a single plane of motion, i.e. avoiding rotation of the resilient member 26 about its central longitudinal axis. Depending on the specific embodiment of the apparatus 10, more or fewer elastic straps 44 could be included and in some embodiments the straps 44 could be omitted. Similarly, the elastic straps 44 could be of various sizes, strengths, shapes, or configurations, depending on the desired stabilization of movement of first and second weights 34, 36. Similar elastic straps 45 are provided between the holding member 50 and the handle portion 20.

In alternative embodiments of the apparatus 10, the first and second weights 34, 36 could include a magnetized element (not shown), on or within, its respective external envelope 48*a* or 48*b*. Depending on the relative polarity between magnetic elements on the weights 34, 36, different effects on the interaction between the weights 34, 36 could be seen. For example, providing the magnetized elements of both the first and second weights 34, 36 with the same polarity (+/+ or −/−) could generally reduce the oscillation between the weights 34, 36, while providing magnetized elements of the weights 34, 36 with opposite polarity (+/−) could increase the amplitude of the oscillation between the weights 34, 36. Reducing or increasing the amplitude of the oscillations could decrease or increase, respectively, the amount of energy that is transmitted to the muscles, joints and/or tendons during exercise drills (described further below).

Referring now to FIG. 3, there is shown an alternative embodiment of an exercise apparatus 110. Elements of the apparatus 110 that are similar to those of the apparatus 10 retain the same reference numeral and will generally not be described again.

Figure 4A:
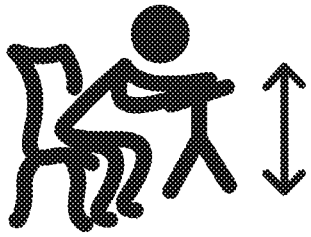
FIGS. 4*a* to 4*j* illustrate different non-limiting examples of uses of the exercise apparatus of FIGS. 1A through 3.
Figure 4B:
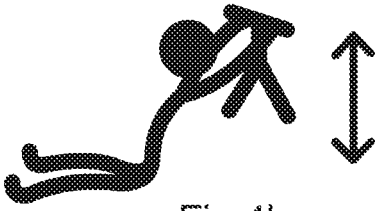
Figure 4C:
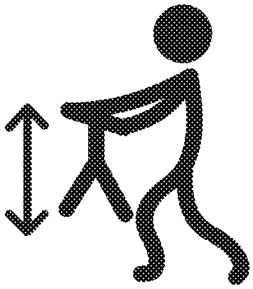
Figure 4D:
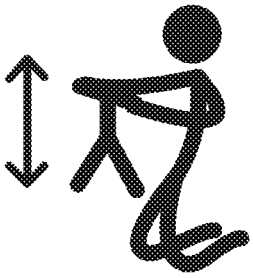
Figure 4E:
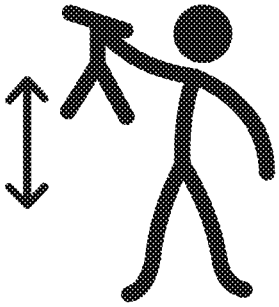
Figure 4F:
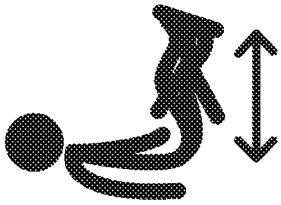
Figure 4H:
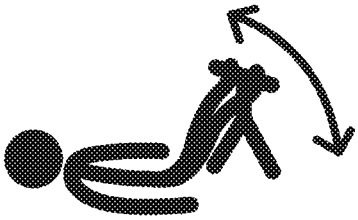
Figure 4G:
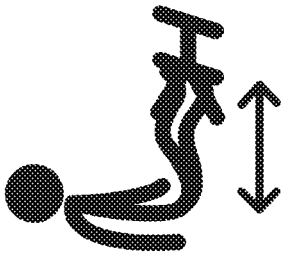
Figure 4I:
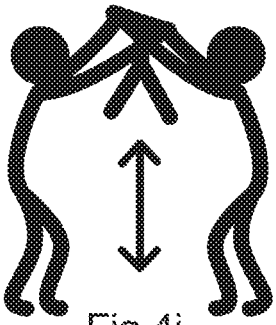
Figure 4J:
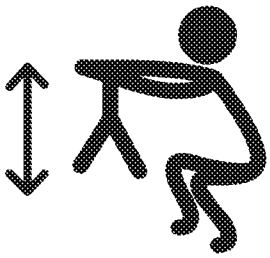

As mentioned above, the apparatus 110, which is illustrated without any protective casing, is similarly constructed to the apparatus 10. The apparatus 110 further includes two handling members 150 extending perpendicularly extend from holding member 50. As shown, the handling members 150, also referred to as sidebars 150, are also oriented perpendicularly to the handle portion 20. In some embodiments, the sidebars 150 could be selectively removable from the apparatus 110. In other embodiments, it is contemplated that the sidebars 150 could be provided in place of the body 12 and the handle portion 20, rather than in addition thereto. The sidebars 150 are adapted to provide the user of the apparatus 110 additional possible exercise drill configurations. An example of such an exercise configuration is illustrated in FIG. 4*g*, where the user is operating the apparatus 110 with his two feet. Use of the apparatus 110 is contemplated with body parts other than the hands or feet as well. Depending on the specific embodiment of the apparatus 110, the sidebars 150 could take a variety of shapes, configurations and/or positions.

Still referring to FIG. 3, the apparatus 110 further includes the additional weight 152 connected to the bracket 55 by the additional spring 154, as mentioned above. The spring 154 and weight 152 are selectively removable from the bracket 55. In some embodiments, the weight 152 could be connected to the bracket 55 by a non-resilient member or directly to the bracket 55. The additional spring 154 and weight 152 are provided to allow the user to perform additional exercising drills and/or change the difficulty of a particular exercise drill. In some cases, the weight 152 may oscillate relative to the holding member 50, providing a pendulum-like motion.

Figure 5:
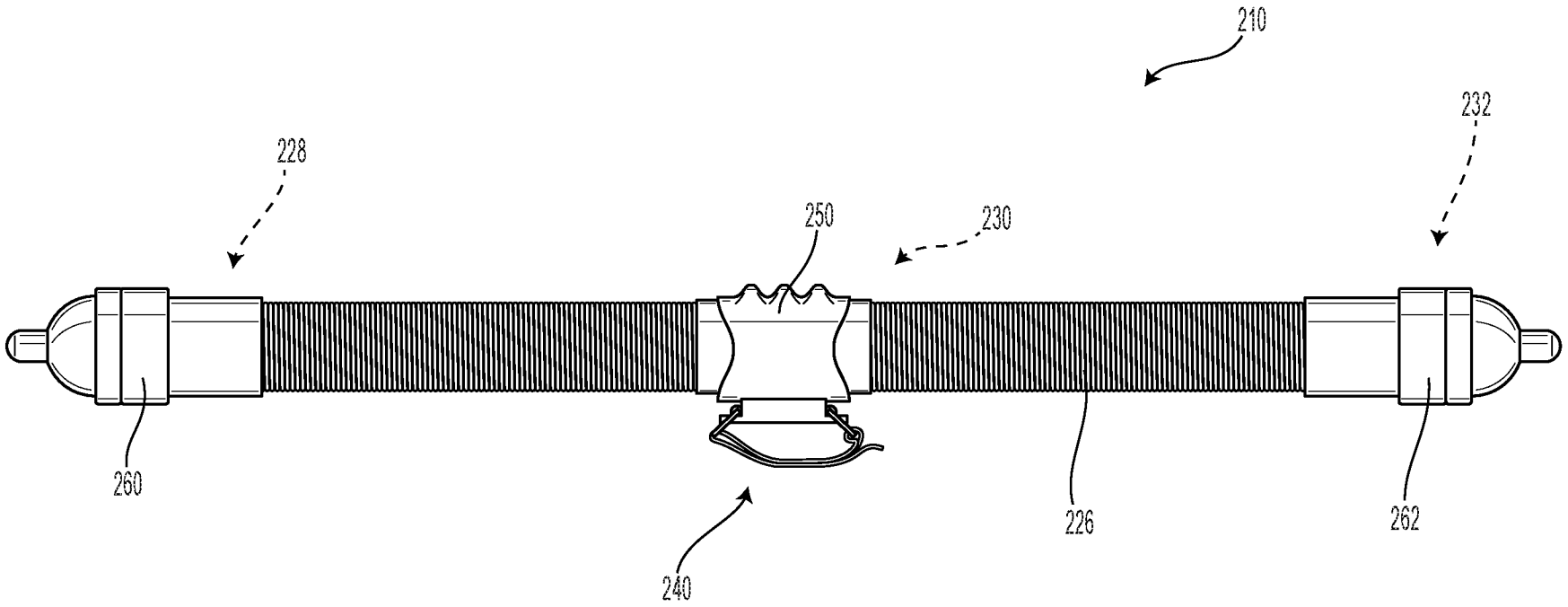
FIG. 5 is a front elevation view of yet another embodiment of an exercise apparatus according to the present technology.

Yet another embodiment of an exercise apparatus 210 is illustrated in FIG. 5. Elements of the apparatus 210 that are similar to those of the apparatus 10 retain the same reference numeral and will generally not be described again.

The apparatus 210 includes a resilient member 226. In this embodiment, the resilient member 226 is a coil spring 226, but it is contemplated that the member 226 could be formed from different materials. The resilient member 226 defines a first end portion 228, a second end portion 232, and a center portion 230 between and approximately equidistant from the first and second end portions 228, 232.

The apparatus 210 includes a holding member 250 connected to the center portion 230 of the resilient member 226. Specifically, the member 250 receives the resilient member 226 therethrough, and the member 250 is glued to the resilient member 226. The holding member 250 is ergonomically formed to receive a hand of the user, although different shapes are contemplated. The apparatus 210 also includes a strap 240, for aiding the user in holding the apparatus 210. It is contemplated that the strap 240 be configured to wrap around the hand, foot, arm or leg of the user while using the apparatus 210.

The apparatus 210 further includes a first weight 260 connected to the first end portion 228 of the resilient member 226 and a second weight 262 connected to the second end portion 232 of the resilient member 226.

The resilient member 226 is generally rigid such that the bar 226 extends horizontally when held at the center portion 230 and the apparatus 210 is not in motion, the first and second end portions 228, 232 remaining generally aligned with the center portion 230. Being formed from a stiff coils spring, the resilient member 226 does allow for slight flexion and vibration when the apparatus 210 is moved up and down in a generally vertical direction (the resilient member 226 being horizontally oriented). The user shakes the apparatus 210 in their hand or in another configuration (described further below), causing oscillations of the resilient member 226 and weights 260, 262.

In some embodiments, the apparatus 10, 110, 210 could further include a harness (not shown) removably connected to the body 12 and/or the holding member 50 to provide the additional configurations of exercising drills. It is contemplated that additional accessories could be designed to work with the apparatus 10, 110, 210, depending on the specific exercise needs of a particular user. Such accessories could include handling accessories to provide different manners of holding or handling the apparatus 10, 110, 210 and/or resistance accessories to change the type of exercise drill or difficulty level thereof. For example, the handling accessory could be a hand crankset. It is also contemplated that for the apparatus 210, the holding member 250 could be mounted on a helmet or other headgear.

Turning back to FIGS. 1*a* to 2*b*, an alternative embodiment of the apparatus 10 will be described. As the external appearance of such an embodiment is very similar to that of the apparatus 10, the same figures are being used and additional reference numerals have simply been added to these Figures. In this embodiment, the resilient member 26 has been replaced by two resilient members 26*a*, 26*b*, which in this embodiment are coil springs 26*a*, 26*b*. The proximal end portions of the resilient members 26*a*, 26*b* are connected on opposite sides of the holding member 50. The weights 34, 36 are mounted to the distal end portions of the resilient members 26*a*, 26*b*. Other features of this embodiment are the same as those of the apparatus 10, and as such will not be described in detail herein.

Use of the apparatus 10 by the user will now be described in more detail. In FIGS. 4*a* to 4*j*, use of the apparatuses 10, 110 and a variety of exercise drills using the apparatus 10, 110, 210 are schematically illustrated. The illustrated exercises are simply meant to provide examples of possible uses, and are not meant to be limiting.

As is illustrated by the simple configuration in FIG. 4*a*, one non-limiting method of using the apparatus 10 is as follows. The user grips the handle portion 20 using his two hands and causes the apparatus 10, 110 to displace along the axis 18 (generally vertically) with a shaking motion. Due to the resilient/elastic properties of the body 12, the second end 16 of the body 12 oscillates relative to the first end 14. This movement of the body 12, and thus the holding member 50, causes the center portion 30 of the resilient member 26 to move up and down in a generally vertical motion as well. Due to the resilient nature of the resilient member 26, the first and second ends 28, 32 to flex relative to the holding member 50 and to begin to oscillate. For the apparatus 210, the user would hold the holding member 250 directly and move the holding member 250 in a generally vertical up and down motion to initiate oscillations.

Upon oscillation of the first and second ends 28, 32, 228, 232 the weights 34, 36, 260, 262 are cause to move along generally arcuate paths (paths 40*a*, 40*b* for the apparatus 10, 110, see FIGS. 1*a*, 2*a*). As is briefly mentioned above, the elastic straps 44 aid in preventing the resilient member 26 from twisting and in maintaining motion of the weights within a single plane. The kinetic energy of the movement of the weights 34, 36, 260, 262 is then transferred back to the resilient member 26, 226 which it stores as potential energy. When the resilient member 26, 226 discharges the potential energy back to kinetic energy, the center portion 30 of the resilient member 26, 226 (and thus the apparatus 10, 110, 210 overall) is also induced to move.

As such, energy transferred from the user to cause the apparatus 10, 110, 210 to begin moving is transferred to the resilient member 26, 226, the weights 34, 36, 260, 262 and then back to the muscles, joints and/or tendons of the user. The particular muscles, joints, and/or tendons affected will depend on the particular exercise/use of the apparatus. Holding and causing the apparatus 10, 110, 210 to oscillate in such a manner causes those muscles reacting to control the apparatus 10, 110, 210 to engage and activate. In some cases, this activity may cause the user to exercise their myotatic reflexes, where muscle tissue contracts in response to stretching of a muscle. In the exercise demonstrated in FIG. 4*a*, for example, different muscles, joints, and tendons of the user's arms or core may be exercised.

In operating the apparatus 10, 110, 210, using different exercise drills (FIGS. 4*a* to 4*j*), different repetition numbers, different displacement patterns, different angles (orientation of the body itself or of the apparatus 10, 110), different movement velocities, etc., different muscles, joints and/or tendons may be targeted to receive a desired amount of energy to exercise the user's body while aiming to minimize the energy deployed by the user. It is also contemplated that different masses for the weights 34, 36, 260, 262 could also be implemented to affect the training received when using the apparatus 10, 110, 210. Changing the mass of the weights 34, 36, 260, 262 could, for example, effect the resistance and difficulty of performing exercise drills with the apparatus 10, 110, 210.

As specific muscle groups are targeted without requiring a full body effort, the apparatus 10, 110, 210 could be used to aid persons to train a selected muscles, joints, and/or tendons who might be otherwise incapable of strenuous or whole-body exercise. For example, the apparatus 10, 110, 210 may help athletes, injured people, and/or elders to train or recover from injuries, using the dynamic movements in a nearly-isometric and stretch reflex contraction exercise. The apparatus 10, 110, 210 may also in some cases be used to gain specific skills normally trained by more intense exercise or by practicing a sport, such as strength-training skills, endurance and/or sprint training skills.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

The invention claimed is:

1. An exercise apparatus comprising:

a holding member;

a first resilient member having first and second end portions, the first end portion being connected to the holding member;

a first weight connected to the second end portion of the first resilient member;

a second resilient member having first and second end portions, the first end portion being connected to the holding member opposite the first end portion of the first resilient member;

a second weight connected to the second end portion of the second resilient member;

a handle portion connected to the holding member; and a spring connected between the handle portion and the holding member.

2. The exercise apparatus of claim 1, further comprising at least one handling member extending from the holding member.

3. The exercise apparatus of claim 1, further comprising first and second protective casings disposed around the first and second resilient members respectively.

4. The exercise apparatus of claim 1, wherein, when the apparatus is held aloft by the holding member:

the first weight weighs enough the flex the distal end portion of the first resilient member downward with respect to the holding member; and the second weight weighs enough the flex the distal end portion of the resilient member downward with respect to the holding member.

5. The exercise apparatus of claim 1, wherein the first and second resilient members are coil springs.

6. An exercise apparatus comprising:

a holding member;

a first resilient member having first and second end portions, the first end portion being connected to the holding member;

a first weight connected to the second end portion of the first resilient member;

a second resilient member having first and second end portions, the first end portion being connected to the holding member opposite the first end portion of the first resilient member;

a second weight connected to the second end portion of the second resilient member; and at least one receiving member connected to the holding member, the at least one receiving member being configured for removably connecting at least one of a weight and a spring.

7. The exercise apparatus of claim 6, further comprising a handle portion connected to the holding member.

8. The exercise apparatus of claim 7, further comprising a spring connected between the handle portion and the holding member.

9. The exercise apparatus of claim 6, further comprising at least one handling member extending from the holding member.

10. The exercise apparatus of claim 6, further comprising first and second protective casings disposed around the first and second resilient members respectively.

11. The exercise apparatus of claim 6, wherein, when the apparatus is held aloft by the holding member:

the first weight weighs enough the flex the distal end portion of the first resilient member downward with respect to the holding member; and the second weight weighs enough the flex the distal end portion of the resilient member downward with respect to the holding member.

12. The exercise apparatus of claim 6, wherein the first and second resilient members are coil springs.

* * * * *